US006077151A

United States Patent [19]

Black et al.

[11] Patent Number: 6,077,151

[45] Date of Patent: Jun. 20, 2000

[54] TEMPERATURE CONTROL CARRIER HEAD FOR CHEMICAL MECHANICAL POLISHING PROCESS

[75] Inventors: Andrew J. Black; Landon Vines, both of San Antonio, Tex.

[73] Assignee: VLSI Technology, Inc., San Jose, Calif.

[21] Appl. No.: 09/313,233

[22] Filed: May 17, 1999

[51] Int. Cl.[7] ..... B24B 49/00

[52] U.S. Cl. ..... 451/53; 451/41; 451/398; 451/287

[58] Field of Search ..... 451/41, 53, 285, 451/287, 288, 7, 385, 397, 398

[56] References Cited

U.S. PATENT DOCUMENTS

| | | | |
|---|---|---|---|
| 5,036,630 | 8/1991 | Kaanta et al. | 451/53 |
| 5,605,488 | 2/1997 | Ohashi et al. | 451/41 |
| 5,797,789 | 8/1998 | Tanaka et al. | 451/7 |
| 5,873,769 | 2/1999 | Chiou et al. | 451/7 |

*Primary Examiner*—Eileen P. Morgan
*Attorney, Agent, or Firm*—Douglas L. Weller

[57] ABSTRACT

The temperature of a wafer is controlled during a chemical mechanical polishing process. Fluid containment is provided on a wafer backing plate in contact with the wafer during the chemical mechanical polishing process. Transportation of fluid is provided to and from the fluid containment during the chemical mechanical polishing process. Temperature of the fluid is controlled in order to control temperature on the wafer during the chemical mechanical polishing process.

13 Claims, 3 Drawing Sheets

TEMPERATURE CONTROL CARRIER HEAD FOR CHEMICAL MECHANICAL POLISHING PROCESS

BACKGROUND

The present invention concerns processing of integrated circuits and pertains particularly to a temperature control carrier head for a chemical mechanical polishing process.

A standard chemical mechanical polishing (CMP) carrier head, such as a ViPPr carrier head available on a Strasbaugh 60DS-SP chemical mechanical polisher, transfers pressure on the back of a wafer to the front of the wafer to control the polish rate as the front of the wafer is being polished. The amount of pressure can increase or decrease the polish rate on the front of the wafer. An increase or decrease in the pressure results in a respective increase or decrease in the polishing rate. Varying the polishing rate across the wafer is done by changing localized back pressure on the wafer.

Heat generated by friction during the polishing process as well as the ambient temperature affects the chemical reaction of slurry used during CMP. If there is too much temperature variation over the surface of the wafer, this can impact uniformity of the polishing performed.

Further, CMP carrier heads use a retainer ring to hold a wafer secure during polishing. The retaining ring exterts pressure on the polishing pad which can change the polishing rate near the edge of the wafer.

SUMMARY OF THE INVENTION

In accordance with the preferred embodiment of the present invention the temperature of a wafer is controlled during a chemical mechanical polishing process. Fluid containment is provided on a wafer backing plate in contact with the wafer during the chemical mechanical polishing process. For example, fluid containment is accomplished using a flexible membrane. The fluid may be liquid or gas. Alternatively, fluid containment is within radial grooves on a bottom of the wafer backing plate, for example using tubes.

Transportation of fluid is provided to and from the fluid containment during the chemical mechanical polishing process. For example, fluid transportation is provided via tubes between a fluid container and the fluid containment.

Temperature of the fluid is controlled in order to control temperature on the wafer during the chemical mechanical polishing process. For example, the fluid is ethylene glycol.

In one embodiment of the present invention, at least two separate fluid containment systems are provided which allow differential radial temperature control of the wafer during the chemical mechanical polishing process. Different fluid transportation systems are provided which allow separate fluid to circulate through each of the at least two separate fluid containment systems. Fluid temperature is controlled in separate fluid containers, one for each of at least the two separate fluid containment systems.

A temperature control carrier head designed in accordance with the preferred embodiments of the present invention will typically have the same abilities as a standard carrier head, but will include the extra advantage of temperature control of the wafer. This allows additional control over the chemical reaction of the slurry used during chemical mechanical polishing, which will result in an improvement in controlling the uniformity of polishing across the wafer.

The present invention allows improvement of the selectivity of the polish process by controlling the slurry and wafer temperature. The present invention allows reduction of the defect level of the wafer by decreasing the chemical reaction at the wafer surface. This is due to the ability to control the temperature of the wafer at the end of the polish. A lower temperature reduces the rate at which the chemical reaction occurs at the wafer surface. The ability to control the temperature of the wafer during the polish process reduces the consumable cost due, for example, to decreased wear on the retaining rings of the carrier.

Using the present invention allows control of the temperature of the back of a wafer during polishing. The result of using the present invention is a uniform surface of the wafer with lower defects after chemical mechanical polishing. This gives a higher wafer yield, lower cost per wafer, and improves the reliability for resulting processed devices.

DESCRIPTION OF THE PREFERRED EMBODIMENT

Figure 1:
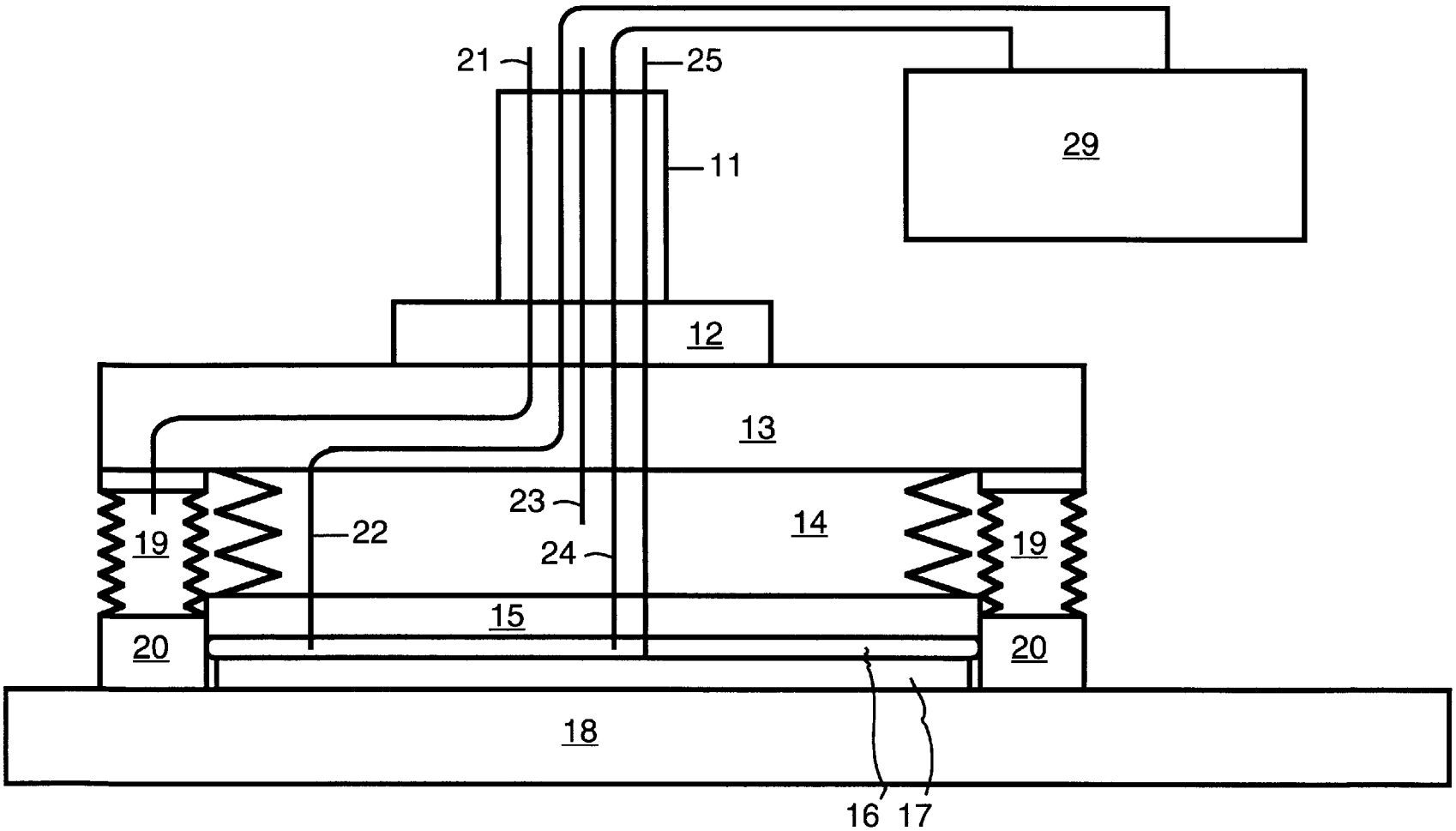
FIG. 1 is a simplified side view that illustrates operation of a temperature control carrier for a chemical mechanical polishing process in accordance with a preferred embodiment of the present invention.

FIG. 1 is a simplified side view that illustrates operation of a temperature control carrier for a chemical mechanical polishing process. During the chemical mechanical polishing process, the substrate of a wafer 17 is polished by a polisher pad 18. A quick release collar 12 is placed over a holding rod 11.

During the chemical mechanical polishing process, air pressure is used to increase wafer pressure chamber 14 against a base plate 13 and a wafer backing plate 15. This results in pressure being placed upon wafer 17. An air tube 23 is used to control air pressure within wafer pressure chamber 14. A retaining ring 20 is held in place by air pressure within a retaining ring pressure chamber 19. An air tube 21 is used to control air pressure within retaining ring pressure chamber 19. An air tube 25 is used to create a vacuum which holds wafer 17 to wafer backing plate 15 during transportation of wafer 17.

The temperature control carrier utilizes fluid within a flexible membrane 16 to provide temperature control of wafer 17 during the chemical mechanical polishing process. Using temperature control provides additional control over the chemical reaction of the slurry. This results in an improvement in controlling the uniformity across wafer 17. Using temperature control also helps in the improvement of the selectivity of the polish process by controlling the slurry and wafer temperature. Using temperature control also reduces the defect level of the wafer by decreasing the chemical reaction at the surface of wafer 17. This is due to the ability to control the temperature of wafer 17 at the end of the polish. The ability to control the temperature of wafer 17 during the process will reduce the consumable cost due to decrease wear on the retaining rings of the carrier.

For example, flexible membrane 16 is made from rubber. A fluid solution is transferred from a fluid container 29, such as a chiller, via a tube 22 and back into fluid container 29 via a tube 24. This arrangement allows temperature of the solution to be controlled. For example, the solution is ethylene glycol. Ethylene glycol can be used to both raise and lower temperature of wafer 17. This is desirable as there are some operating instances where wafer 17 needs to be cooled and other instances where wafer 17 needs to be heated. Other appropriate fluids (liquid or gas) may be used instead of ethylene glycol.

Figure 2:
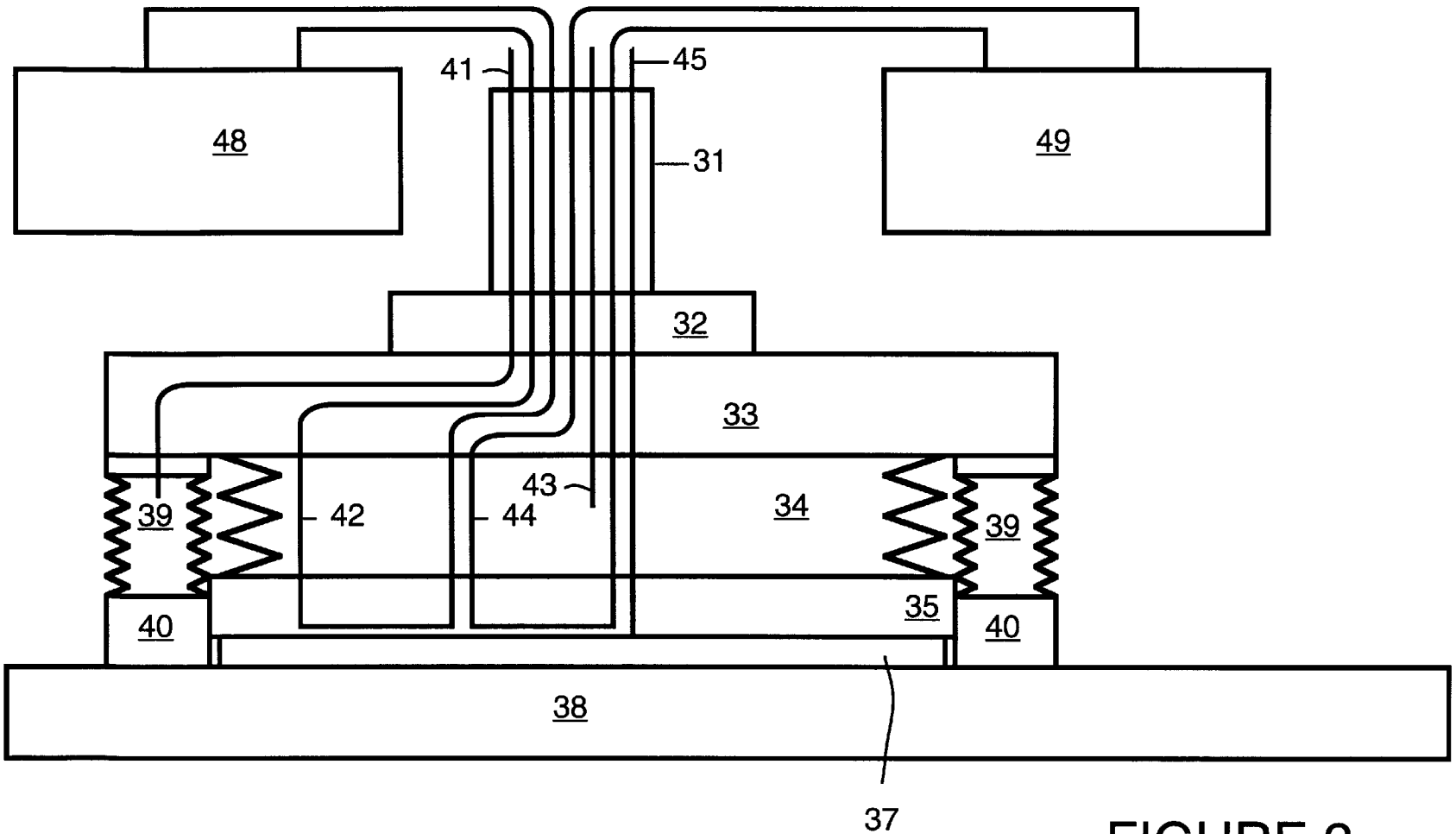
FIG. 2 is a simplified side view that illustrates operation of a temperature control carrier for a chemical mechanical polishing process in accordance with another preferred embodiment of the present invention.

FIG. 2 is a simplified side view that illustrates operation of a temperature control carrier for a chemical mechanical polishing process in accordance with an alternate embodiment of the present invention. During the chemical mechanical polishing process, the substrate of a wafer 37 is polished by a polishing pad 38. A quick release collar 32 is placed over a holding rod 31.

During the chemical mechanical polishing process, air pressure is used to increase wafer pressure chamber 34 against a base plate 33 and a wafer backing plate 35. This results in pressure being placed upon wafer 37. An air tube 43 is used to control air pressure within wafer pressure chamber 34. A retaining ring 40 is held in place by air pressure within a retaining ring pressure chamber 39. An air tube 41 is used to control air pressure within retaining ring pressure chamber 39. An air tube 45 is used to create a vacuum which holds wafer 37 to wafer backing plate 35 during transportation of wafer 37.

The temperature control carrier utilizes fluid within tubes arranged within radial grooves on the bottom of wafer backing plate 35 in order to provide temperature control of wafer 37 during the chemical mechanical polishing process. The fluid may be liquid or gas. Using temperature control provides additional control over the chemical reaction of the slurry.

For example, the radial grooves are separated into separate sections. This design gives the flexibility to distribute the temperature to certain parts of wafer 17, which results in greater radial control of the polish rate of the process.

For an outer radial section, a fluid solution is transferred to and from a fluid container 48, such as a chiller, via a tube 42. For an inner radial section, a fluid solution is transferred to and from a fluid container 49, such as a chiller, via a tube 44. This arrangement allows for temperature compensation, necessary, for example, when polishing conditions create greater polishing speed at the outer regions of wafer 37. While, FIG. 2 shows division into two radial sections, additional divisions can be made resulting in additional radial sections and increased temperature control.

Figure 3:
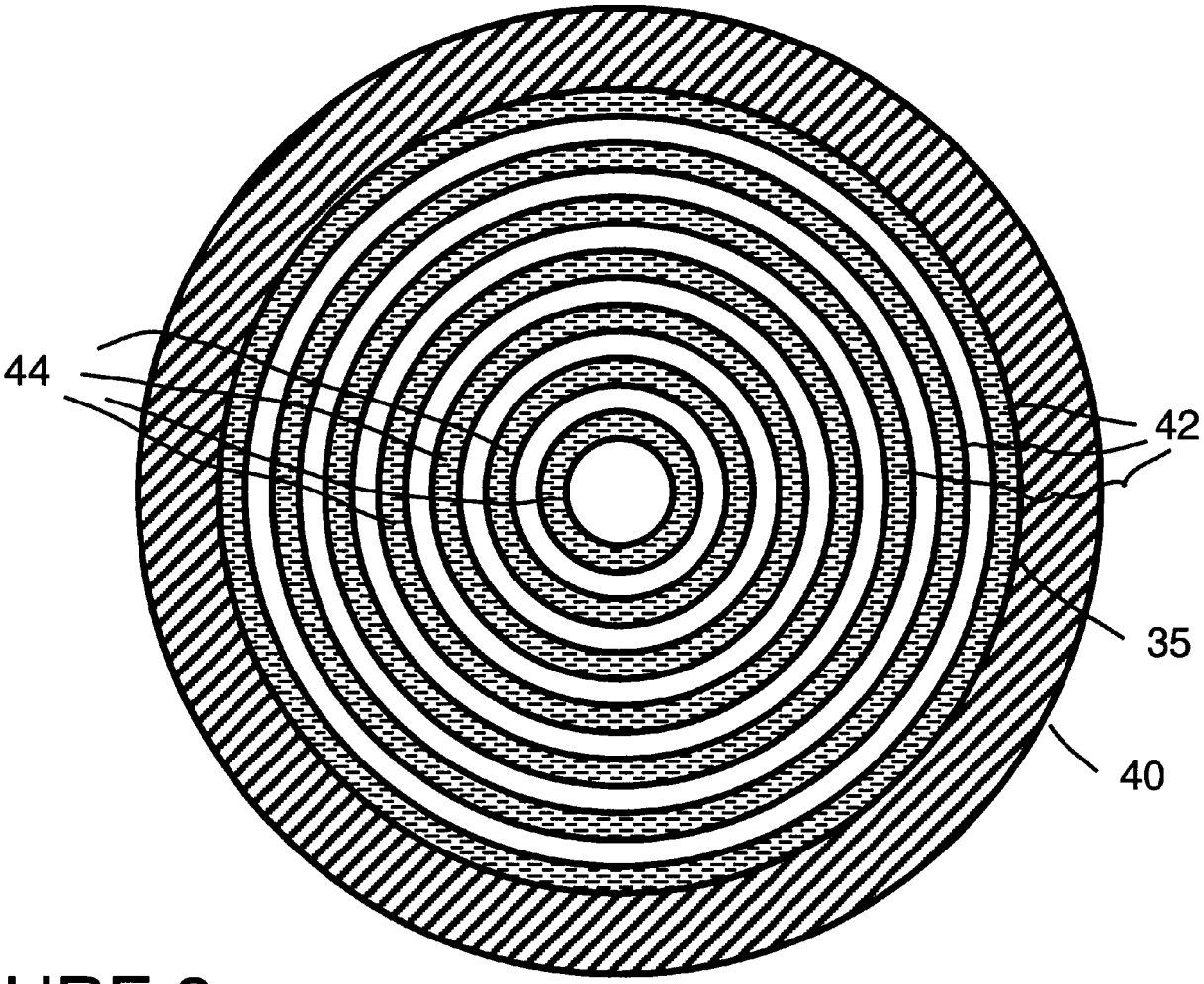
FIG. 3 is a simplified diagram of a bottom of the temperature control carrier shown in FIG. 2 in accordance with a preferred embodiment of the present invention.

FIG. 3, shows a bottom view of wafer backing plate 35. Tubes 42, filled with fluid, are shown in radial grooves on wafer backing plate 35 with larger radii. Tubes 44, filled with fluid, are shown in radial grooves on wafer backing plate 35 with smaller radii. Retainer ring 40 is also shown.

Alternatively, electrical current may be used to provide temperature control (heat only) to a wafer backing plate. In this case, resistive material is used to replace tubes 44. Fluid container 48 and fluid container 49 are replaced with current generators. Tube 42 and tube 44 are replaced with conductive wire.

The foregoing discussion discloses and describes merely exemplary methods and embodiments of the present invention. As will be understood by those familiar with the art, the invention may be embodied in other specific forms without departing from the spirit or essential characteristics thereof.

For example, electrical current may be used to provide temperature control (heat only) to a wafer backing plate. In this case, resistive material is used to replace the portion of tubes 42 and tubes 44, visible on the bottom view of wafer backing plate 35, as shown in FIG. 3. The remaining portions of tube 42 and tube 44 (shown in FIG. 2) are replaced with conductive wire. Fluid container 48 and fluid container 49 are replaced with current generators.

Accordingly, the disclosure of the present invention is intended to be illustrative, but not limiting, of the scope of the invention, which is set forth in the following claims.

We claim:

1. A method for controlling temperature of a wafer during a chemical mechanical polishing process, the method comprising the following steps:

(a) providing fluid containment via tubing placed within radial grooves on a wafer backing plate, the tubing being in contact with the wafer during the chemical mechanical polishing process;

(b) providing transportation of fluid to and from the fluid containment during the chemical mechanical polishing process; and, (c) controlling temperature of the fluid during the chemical mechanical polishing process in order to control temperature on the wafer during the chemical mechanical polishing process.

2. A method as in claim 1 wherein in step (c) the fluid is ethylene glycol.

3. A method as in claim 1 wherein in step (a) at least two separate fluid containment systems are provided which allow differential radial temperature control of the wafer during the chemical mechanical polishing process.

4. A method as in claim 3 wherein in step (b) at least two separate fluid transportation systems are provided which allow separate fluid to circulate through each of the at least two separate fluid containment systems.

5. A method as in claim 3 wherein in step (c) fluid temperature is controlled in at least two separate fluid containers, one for each of at least the two separate fluid containment systems.

6. A method as in claim 1 wherein in step (c) fluid temperature is controlled using a fluid container.

7. A wafer carrier used in a chemical mechanical polishing process, the temperature control carrier comprising:

a wafer backing plate, the wafer backing plate having radial grooves; and, a temperature control system for controlling temperature of a wafer held by the wafer backing plate, the temperature control system including tubing placed within the radial grooves, the tubing being situated on the wafer backing plate so that the tubing is in contact with wafers carried by the wafer carrier.

8. A wafer carrier as in claim 7 wherein the temperature control system comprises:

liquid transportation system for providing liquid to the the tubing situated on the wafer backing plate.

9. A wafer carrier as in claim 7 wherein the temperature control system comprises:

gas transportation system for providing gas to the the tubing situated on the wafer backing plate.

10. A wafer carrier as in claim 7 additionally comprising:

fluid transportation system for providing fluid to the tubing.

11. A wafer carrier as in claim 10 wherein the fluid transportation system comprises:

a fluid container; and, tubes extending between the fluid container and the tubing situated on the wafer backing plate.

12. A wafer carrier as in claim 10 wherein the fluid is ethylene glycol.

13. A wafer carrier as in claim 7 wherein the tubing includes two separate tubes, each tube being connected to a different fluid container thereby allowing differential radial temperature control of the wafer during the chemical mechanical polishing process.

* * * * *